US007520131B2

(12) United States Patent
Sakikawa et al.

(10) Patent No.: US 7,520,131 B2
(45) Date of Patent: Apr. 21, 2009

(54) PUMP UNIT

(75) Inventors: Shigenori Sakikawa, Hyogo (JP); Tomoyuki Tsuji, Hyogo (JP); Takeaki Nozaki, Hyogo (JP)

(73) Assignee: Kanzaki Kokyukoki Mfg. Co., Ltd., Hyogo (JP)

( * ) Notice: Subject to any disclaimer, the term of this patent is extended or adjusted under 35 U.S.C. 154(b) by 0 days.

(21) Appl. No.: 11/939,800

(22) Filed: Nov. 14, 2007

(65) Prior Publication Data

US 2008/0072587 A1 Mar. 27, 2008

Related U.S. Application Data

(63) Continuation-in-part of application No. 11/139,776, filed on May 31, 2005, now Pat. No. 7,377,106.

(30) Foreign Application Priority Data

Jun. 28, 2004 (JP) ..... 2004-189903

(51) Int. Cl.
*F16D 31/02* (2006.01)

(52) U.S. Cl. ..... 60/486

(58) Field of Classification Search ..... 60/486; 417/374, 426

See application file for complete search history.

(56) References Cited

U.S. PATENT DOCUMENTS

| | | | | |
|---|---|---|---|---|
| 3,065,602 | A * | 11/1962 | Curlett | 60/486 |
| 3,808,813 | A * | 5/1974 | Spinks | 60/486 |
| 5,755,098 | A | 5/1998 | Irikura | |
| 6,425,244 | B1 | 7/2002 | Ohashi et al. | |
| 6,564,891 | B2 | 5/2003 | Ishii et al. | |
| 6,988,580 | B2 | 1/2006 | Ohashi et al. | |
| 7,028,472 | B2 * | 4/2006 | Ohashi et al. | 60/486 |

FOREIGN PATENT DOCUMENTS

| | | |
|---|---|---|
| EP | 1350 420 A1 | 10/2003 |
| JP | 2003-291674 | 10/2003 |

* cited by examiner

*Primary Examiner*—Michael Leslie
(74) *Attorney, Agent, or Firm*—Sterne, Kessler, Goldstein & Fox P.L.L.C.

(57) ABSTRACT

There is provided a pump unit including a plurality of hydraulic pump bodies disposed in parallel to each other, a plurality of pump shafts respectively supporting the plurality of hydraulic pump bodies in a relatively non-rotatable manner and a pump housing accommodating the plurality of pump bodies and supporting the plurality of pump shafts in a rotatable manner around respective axis lines, wherein each of the plurality of pump shafts has at least one end extending outward from the pump housing so as to form an input end.

3 Claims, 12 Drawing Sheets

PUMP UNIT

CROSS-REFERENCE TO RELATED APPLICATION

The present invention is a continuation-in-part of U.S. application Ser. No. 11/139,776, filed May 31, 2005, which is hereby incorporated herein in its entirety by reference thereto.

BACKGROUND OF THE INVENTION

1. Field of the Invention

The present invention relates to a pump unit including a plurality of hydraulic pump bodies disposed in parallel to each other.

2. Related Art

A pump unit including a plurality of hydraulic pump bodies disposed in parallel to each other has been conventionally used in various fields (for example, refer to Japanese patent application unexamined publication JP 2003-291674).

The conventional pump unit includes first and second pump shafts, first and second hydraulic pump bodies respectively driven by the first and second pump shafts, a pump case, and a center section (or a port block) connected to the pump case so as to form a pump accommodating space for accommodating the first and second hydraulic pump bodies in cooperation with the pump case.

The conventional pump unit is configured so that one pump shaft of the first and second pump shafts acts as an input shaft operatively connected to a driving power source and the other pump shaft is operatively connected to the one pump shaft through a gear transmission mechanism.

Specifically, the one pump shaft is supported by a pump housing formed by the pump case and the center section in a rotatable manner around its axis line in a state that one end of the one pump shaft is extended outward from the pump housing.

The conventional pump unit includes, in addition to the above components, the gear transmission mechanism operatively connecting the first and second pump shafts, and a lid member connected to the pump housing so as to form a gear accommodating space for accommodating the gear transmission mechanism in cooperation with the pump housing.

The conventional pump unit has an advantage of transmitting rotational power from the driving power source to both of the first and second pump shafts by operatively connecting the driving source to the first pump shaft. However, on the other hand, it invites a problem of cost increase because it requires the gear transmission mechanism and the lid member to be included.

Another problem caused by the conventional pump unit is that the stored oil inside of the pump accommodating space and the gear accommodating space causes resistance against rotation of the gear transmission mechanism since the conventional pump unit is configured so that the pump accommodating space and the gear accommodating space are fluidly connected to each other, resulting in worsened transmission efficiency from the driving power source to the first and second pump shafts.

In consideration of the above prior art, it is an object of the present invention to provide a pump unit including a plurality of hydraulic pump bodies disposed in parallel to each other, the pump unit capable of achieving cost reduction as much as possible while preventing transmission efficiency from being deteriorated.

SUMMARY OF THE INVENTION

The present invention provides, in order to achieve the object, a pump unit including a plurality of hydraulic pump bodies disposed in parallel to each other, a plurality of pump shafts respectively supporting the plurality of hydraulic pump bodies in a relatively non-rotatable manner and a pump housing accommodating the plurality of pump bodies and supporting the plurality of pump shafts in a rotatable manner around respective axis lines, wherein each of the plurality of pump shafts has at least one end extending outward from the pump housing so as to form an input end, and the pump unit further includes a plurality of input pulleys respectively supported by the input ends of the plurality of pump shafts in a relatively non-rotatable manner.

According to the pump unit, it is possible to form a power transmission mechanism for transmitting power from the driving power source to the first and second pump shafts with reduced cost while preventing transmission efficiency of the power transmission mechanism from being deteriorated.

Preferably, the plurality of pump shafts includes first and second pump shafts disposed in parallel to each other. The first pump shaft has first and second ends respectively positioned on one side and the other side in the axis line direction. The second pump shaft has first and second ends respectively positioned on the same sides as the first and second ends of the first pump shaft in the axis line direction. The first ends of the first and second pump shafts are extended outward from the pump housing to form the input ends. The plurality of input pulleys includes first and second input pulleys respectively supported by the input ends of the first and second pump shafts in a relatively non-rotatable manner. The first and second pulleys are displaced from each other with respect to the axis line direction of the first and second pump shafts.

According to the configuration, it is possible to simplify a power transmission mechanism from the driving power source to the first and second input pulleys while enhancing design freedom of the first and second input pulleys without enlarging a distance between the axis lines of the first and second pump shafts.

More preferably, the pump unit may further include a cooling fan. The cooling fan is supported in a relatively non-rotatable manner by one pump shaft that supports one input pulley of the first and second input pulleys positioned away from the pump housing than the other input pulley, the cooling fan being positioned on one side of the one input pulley in the axis line direction.

According to the configuration, it is possible to provide the cooling fan without deteriorating design freedom.

The present invention also provides, in order to achieve the object, a pump unit including a plurality of hydraulic pump bodies disposed in parallel to each other, a plurality of pump shafts respectively supporting the plurality of hydraulic pump bodies in a relatively non-rotatable manner and a pump housing accommodating the plurality of pump bodies and supporting the plurality of pump shafts in a rotatable manner around respective axis lines, wherein each of the plurality of pump shafts has at least one end extending outward from the pump housing so as to form an input end.

According to the pump unit, it is possible to form a power transmission mechanism for transmitting power from the driving power source to the first and second pump shafts with reduced cost while preventing transmission efficiency of the power transmission mechanism from being deteriorated.

Preferably, the plurality of pump shafts includes first and second pump shafts disposed in parallel to each other. The first pump shaft has first and second ends respectively positioned on one side and the other side in the axis line direction. The second pump shaft has first and second ends respectively positioned on the same sides as the first and second ends of the first pump shaft in the axis line direction. The first ends of the first and second pump shafts are extended outward from the pump housing to form the input ends.

According to the configuration, it is possible to simplify the power transmission mechanism from the driving power source to the first and second pump shafts.

BRIEF DESCRIPTION OF THE DRAWINGS

The above, and other objects, features and advantages of the present invention will become apparent from the detailed description thereof in conjunction with the accompanying drawings wherein.

DETAILED DESCRIPTION OF THE PREFERRED EMBODIMENTS

Embodiment 1

One preferred embodiment of a pump system according to the present invention will be described below with reference to the attached drawings.

Figure 1:
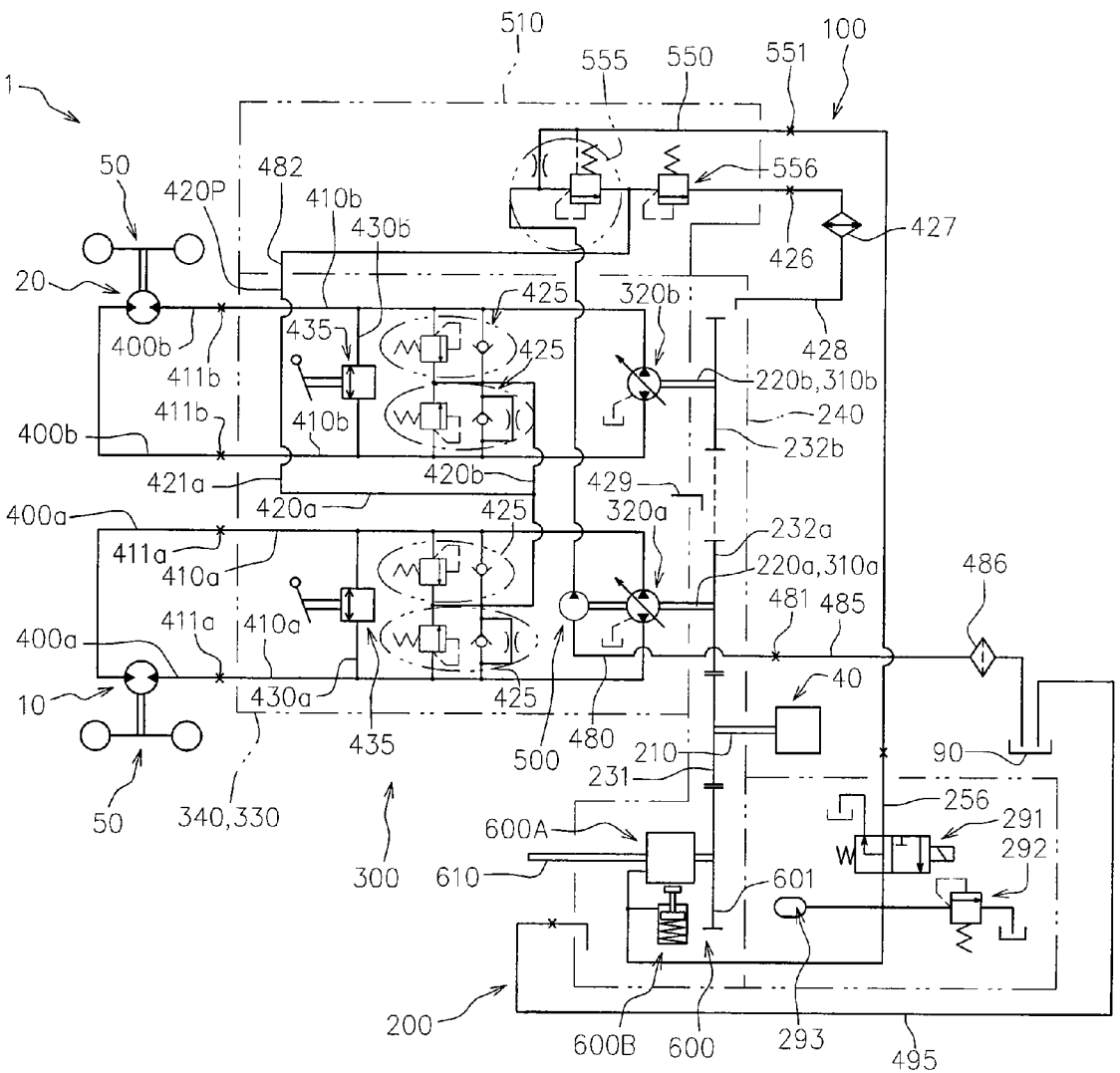
FIG. 1 is a hydraulic circuit diagram of a working vehicle to which a pump system according to a first embodiment of the present invention is applied.
Figure 2:
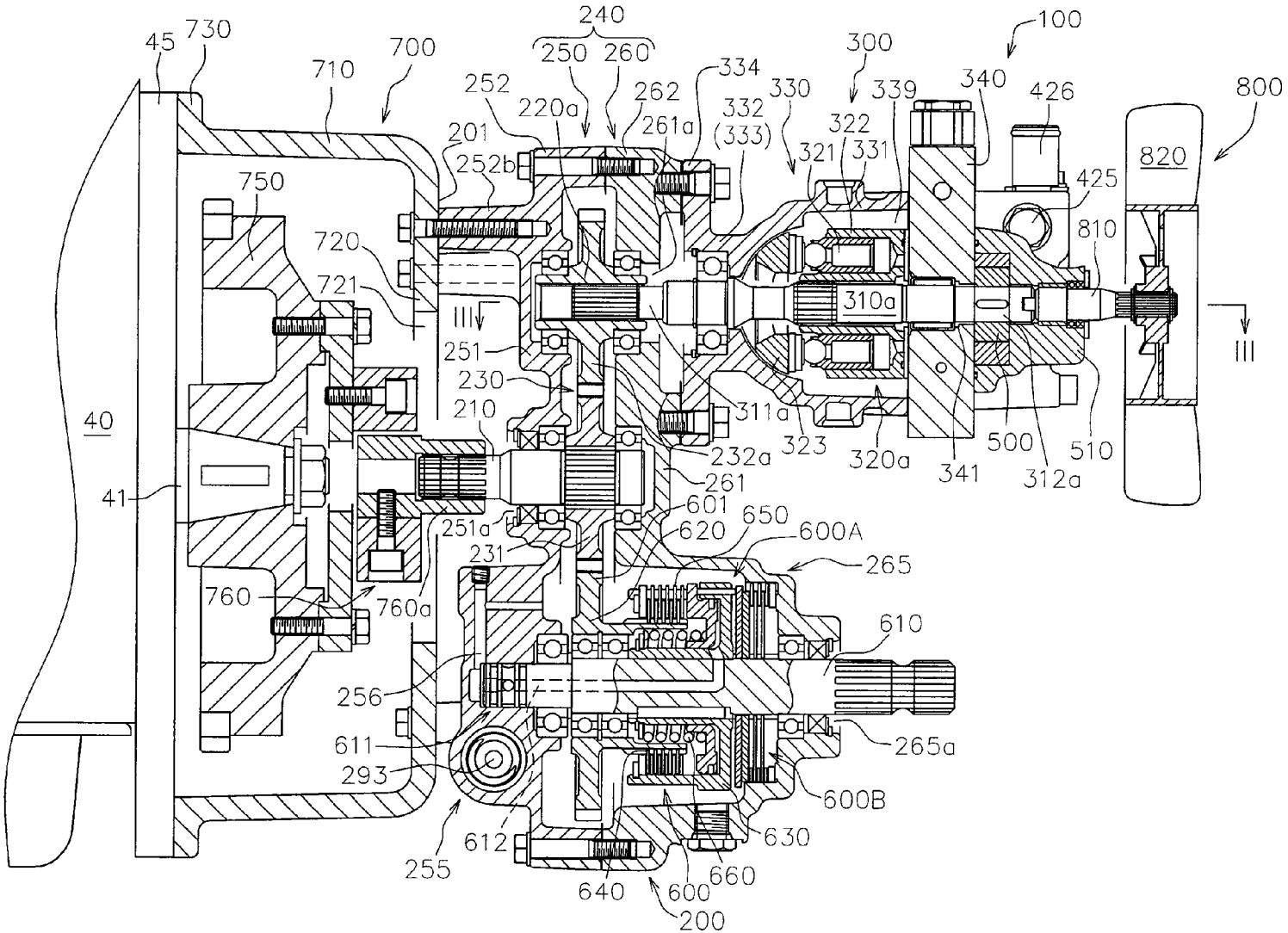
FIG. 2 is a longitudinal development sectional view of the pump system according to the first embodiment of the present invention.

FIG. 1 shows a hydraulic circuit diagram of a working vehicle 1 to which a pump system 100 according to this embodiment is applied. In addition, FIG. 2 shows a longitudinal development sectional view of the pump system 100 according to this embodiment. Further, FIG. 10 shows a schematic side view of the working vehicle 1.

Figure 10:
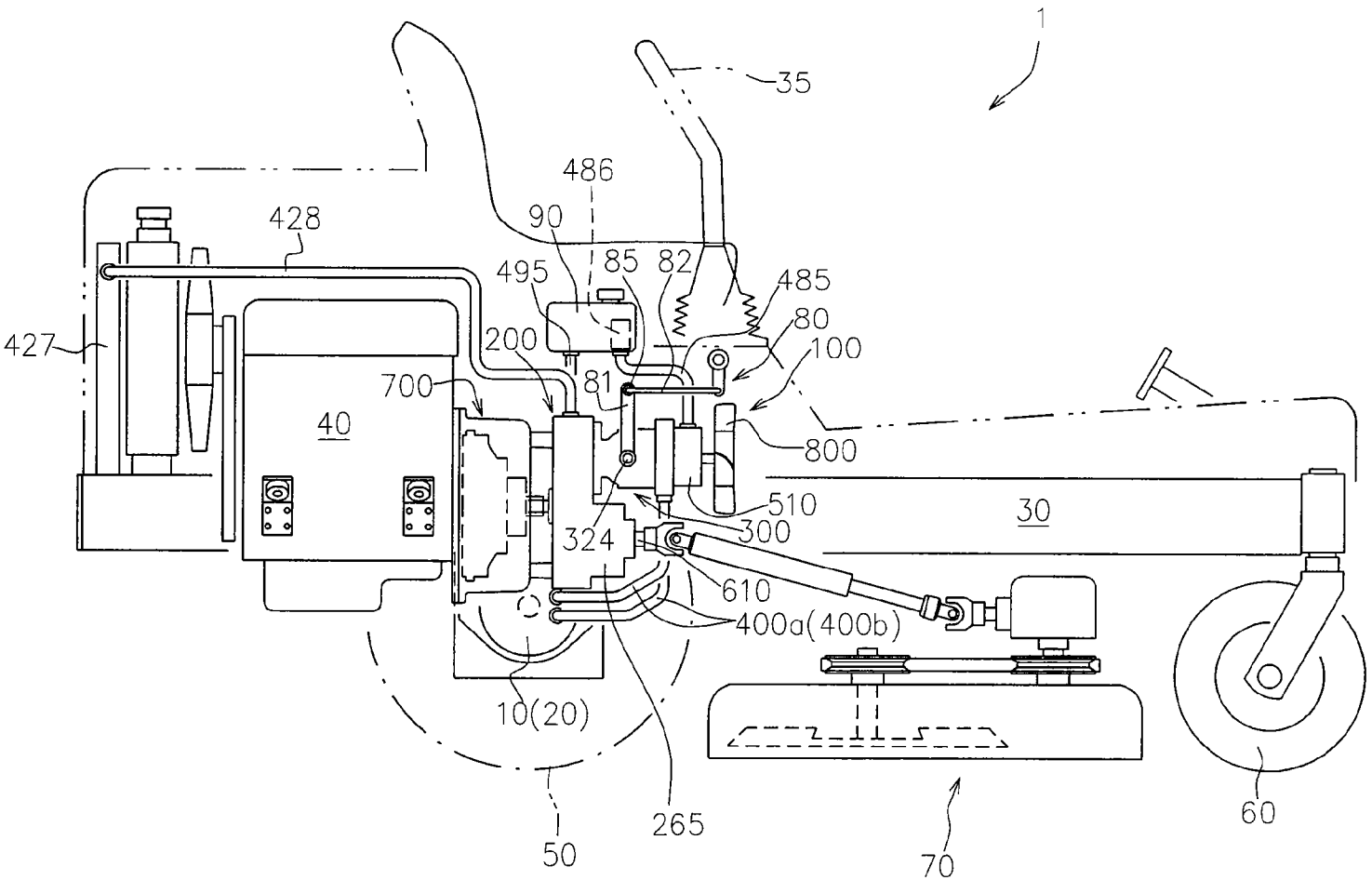
FIG. 10 is a schematic side view of the working vehicle shown in FIG. 1.

As shown in FIG. 1 and FIG. 10, the working vehicle is provided with a vehicle frame 30, a driving source 40 mounted on a rear side of the vehicle frame 30, the pump system 100 operatively connected to the driving source 40, a pair of first and second hydraulic motor units 10, 20 fluidly connected to the pump system 100, a pair of right and left driving wheels 50 (rear wheels in this embodiment) driven by the pair of first and second hydraulic motor units 10, 20, respectively, and a pair of caster wheels 60 (front wheels in this embodiment) separately arranged from the pair of driving wheels in a front-to-rear direction of the vehicle.

The pump system 100 configures a traveling variable speed transmission mechanism in cooperation with the pair of the first and second hydraulic motor units 10, provided to the working vehicle 1, and a part of a PTO transmission mechanism for transmitting a driving power to a working machine such as a mower device or a cultivator to be provided to the working vehicle 1.

According to this embodiment, as shown in FIG. 10, the working vehicle 1 is provided with a mower device 70 that is arranged between the caster wheels 60 and the driving wheels 50 in the front-to-rear direction of the vehicle as the working machine.

More specifically, at least any one of the pump system 100 and/or the first and second hydraulic motor units 10, 20 is (are) made into a variable displacement type so as to form an HST, and the HST configures a part of the traveling transmission mechanism.

In this embodiment, the pump system 100 is made into a variable displacement type. The first and second hydraulic motor units 10, 20 are made into a fixed displacement type.

Further, the pump system 100 is provided with a PTO unit 600 (to be described later), and the PTO unit 600 configures a power source of the PTO transmission mechanism.

The pump system 100 is provided with a base unit 200 mounted on the supporting member, a pump unit 300 detachably connected to the base unit 200, and a PTO unit 600 accommodated into the base unit 200.

The base unit 200 has a single input portion capable of being operatively connected to the driving source 40, a plurality of output portions capable of outputting a power transmitted from the input portion to the outside, a transmission portion 230 for transmitting the power from the input portion to the plurality of output portions and the PTO unit 600, and a base housing 240 for accommodating the transmission portion and the PTO unit 600.

Figure 3:
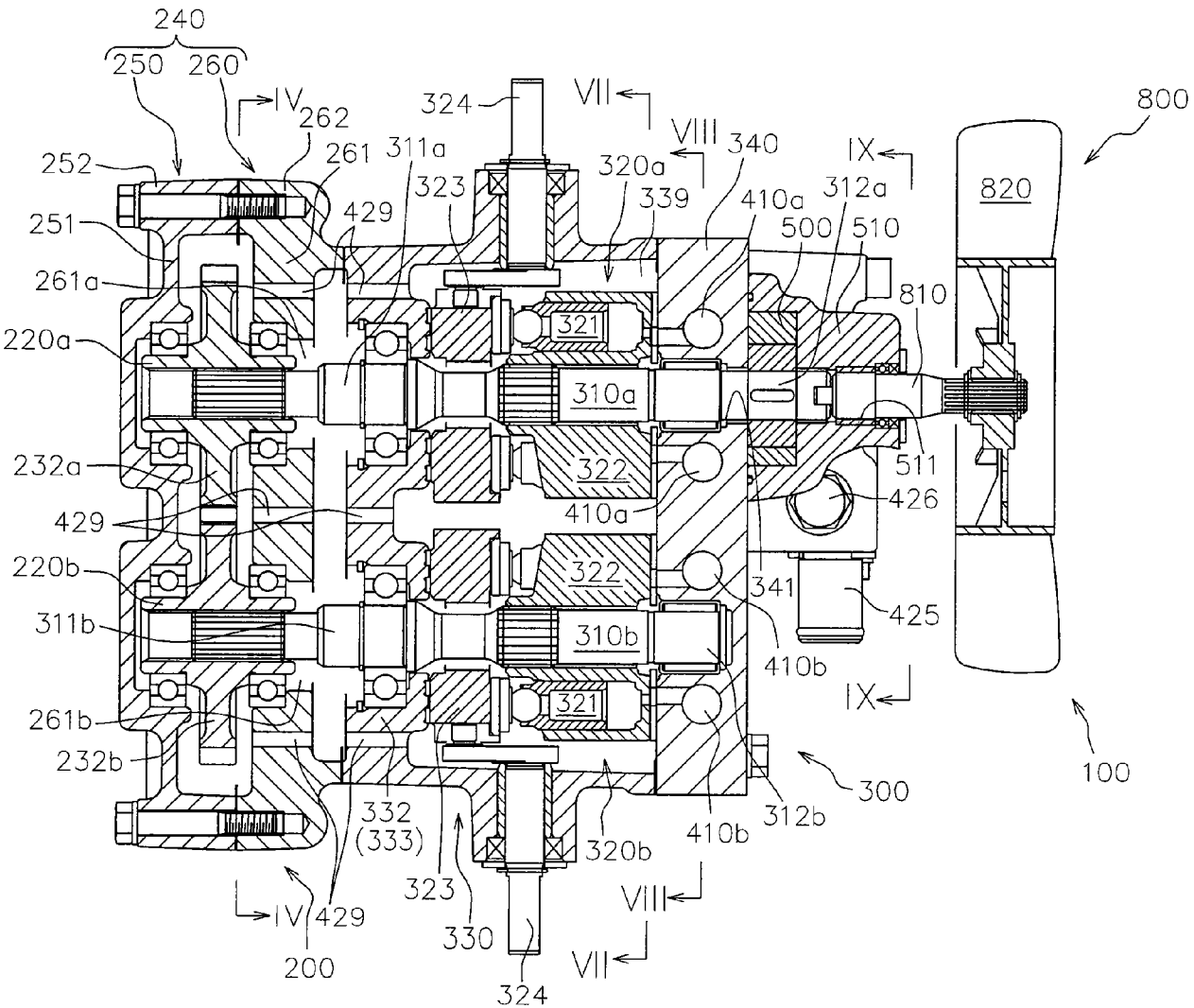
FIG. 3 is a transverse sectional plan view of the pump system taken along line III-III in FIG. 2.

FIG. 3 is a transverse sectional plan view of the pump system 100 taken along line III-III in FIG. 2.

Figure 4:
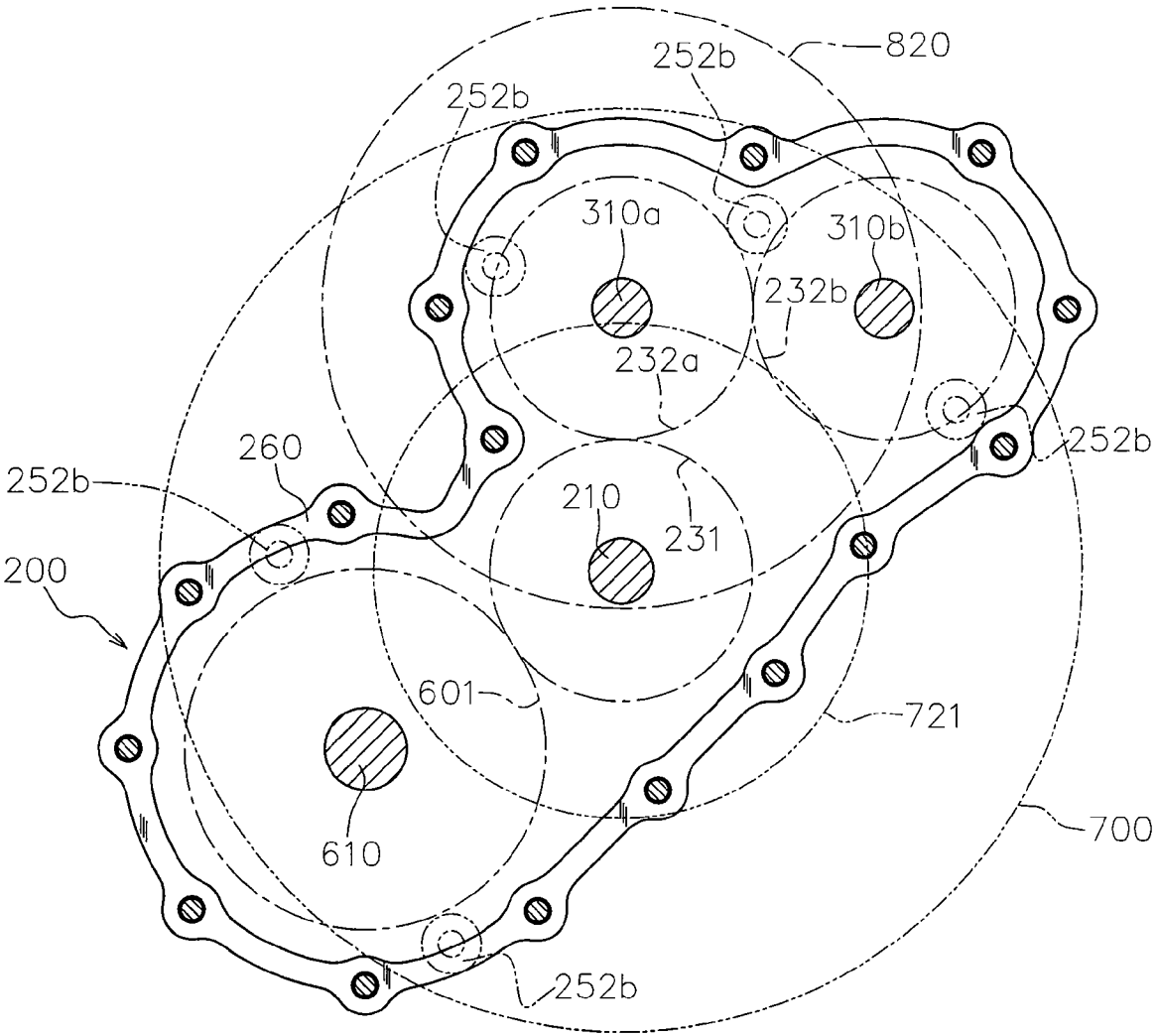
FIG. 4 is an end face view of the pump system taken along line IV-IV in FIG. 3.

FIG. 4 is an end face view of the pump system 100 taken along line IV-IV in FIG. 3.

Specifically, as shown in FIGS. 2 to 4, the base unit 200 has an input shaft 210 configuring the input portion, first and second output shafts 220*a*, 220*b* configuring the plurality of output portions, the transmission portion 230 for operatively connecting the input shaft 210 with the first output shaft 220*a*, the second output shaft 220*b* and the PTO unit 600, and the base housing 240 for supporting the input shaft 210, the first output shaft 220*a*, the second output shaft 220*a* and a PTO shaft 610 (to be described later) in the PTO unit 600 and for accommodating the transmission portion 230 and the PTO unit 600.

According to this embodiment, as shown in FIG. 2, the base housing 240 is connected to a mount flange 45 of the driving source 40 via an attachment stay 700.

Specifically, in this embodiment, the driving source 40 is supported by the vehicle frame 30 of a machine body so as to prevent a vibration of the driving source from being transmitted to the frame 30. And the pump system 100 is connected to the driving source 40 via the base housing 240 with free against the frame 30.

More specifically, as shown in FIG. 2, a flywheel 750 and a damper 760 are connected to an output portion 41 of the driving source 40, The attachment stay 700 is configured so that it can connect the base housing 240 to the mount flange 45 of the driving source 40 while evading the flywheel 750 and the damper 760.

In other words, the attachment stay 700 is connected to the mount flange 45 of the driving source 40 so as to form a mount face 201 for the base unit 200 at a downstream side in a transmission direction of the flywheel 750.

Specifically, the attachment stay 700 has a peripheral wall 710 extending in an axial direction of the input shaft 210 so as to cover at least a part of peripheries of the flywheel 750 and the damper 760, an end wall 720 for connecting a first end side in the axial direction of the peripheral wall 710 and forming the mount face for the base housing 240, and a base end flange 730 provided at a second end side in the axial direction of the peripheral wall 710 and connected to the mount flange 45.

Herein, a reference numeral 721 in FIG. 2 denotes an opening formed on the end wall 720. The opening serves to allow connection between the input shaft 210 and a joint 760*a* provided on a rotational axis of the damper 750.

In this embodiment, the peripheral wall 710 is configured so as to cover the entire peripheries of the flywheel 750 (refer to FIG. 2). However it is possible to configure the peripheral wall 710 so as to cover only a part of the peripheries of the flywheel 750 in place of this.

As shown in FIG. 2 and FIG. 3, the base housing 240 has a first housing portion 250 detachably connected to the end wall 720 of the attachment stay 700, and a second housing portion 260 connected to the first housing portion 250 so as to form an accommodating space for accommodating the transmission portion 230 and the PTO unit 600 in cooperation with the first housing portion 250.

Specifically, the first housing portion 250 has a first end wall 251 having a through hole 251*a* through which the input shaft 210 penetrates, and a first peripheral wall 252 extending from the peripheral edge of the first end wall 251 to one side in the axial direction of the input shaft 210.

This first housing portion 250 supports the input shaft 250 so that one end of the input shaft 210 extends outward.

In this embodiment, on the first housing portion 250, a plurality of attachment bosses 252*b* abutting against the attachment stay 700 are integrally erected.

The second housing portion 260 has a second peripheral wall 262 extending in the axial direction of the input shaft 210, and a second end wall 261 for closing one end in the axial direction of the second peripheral wall 262 so as to be opposed to the first end wall 251.

Then, the first and second housing portions 250, 260 can be detachably connected to each other while abutting the end faces of the first peripheral wall 252 against the second peripheral wall 262.

Further, the second housing portion 260 is configured in such a manner that a part of the second end wall 261 is expanded along the axial direction of the input shaft 210 so as to form an expanded portion 265. The expanded portion 265 is so configured to accommodate the PTO unit 600.

The base housing 240 supports the input shaft 210 with allowing the input shaft 210 to be accessed from outsides at its first side. The base housing 240 also supports the first output shaft 220*a*, the second output shaft 220*b* and the PTO shaft 610 with allowing these shafts to be accessed from outsides at its second side opposed to the first end.

In this embodiment, as shown in FIG. 2 and FIG. 3, the first and second output shafts 220*a* and 220*b* are accommodated within an accommodating space of the base housing 240.

Then, first and second access openings 261*a*, 261*b* are provided on the second end wall 261 of the second housing portion 260 to allow the access to the first and second output shafts 220*a*, 220*b* from the outside.

Of course, the first and second output shafts 220*a*, 220*b* can be also supported by the base housing 240 so that first ends thereof extend to the outside of the base housing 240 in place of the illustrated form.

The PTO shaft 610 is supported by the base housing 240 so that its first end extends to the outside.

More specifically, as shown in FIG. 2, a through hole 265*a* through which the PTO shaft 610 penetrates is formed on a portion forming the expanded portion 265 in the second end wall 261.

Then, the PTO shaft 610 is supported by the second end wall 261 and the first end wall 251 with the first one end extended to the outside via the through hole 265*a*.

Herein, a portion, which supports a second end at the opposite side of the first end of the PTO shaft 610 in the first end wall 251, is made into a thick portion 255 (refer to FIG. 2).

Between the inner circumferential surface of a bearing hole formed in the thick portion 255 and the outer circumferential surface of the PTO shaft 610, a rotary joint 611 communicated to a PTO clutch mechanism 600A (to be described later) is formed.

Further, on the thick portion 255, various kinds of hydraulic circuits (to be described later) are provided.

As described above, the transmission portion 230 is configured so as to operatively connect the input shaft 210 to the first output shaft 220*a*, the second output shaft 220*b* and the PTO unit 600.

Specifically, the transmission portion 230 has an input gear 231 that cannot be relatively rotated against the input shaft 210, and first and second output gears 232*a*, 232*b* that cannot be relatively rotated against the first and second output shafts 220*a*, 220*b*, respectively.

In this embodiment, the first and second output gears 232*a*, 232*b* are connected to the input gear 231 in series.

More specifically, as shown in FIG. 4, the first output gear 232*a* is meshed with the input gear 231, and the second output gear 232*b* is meshed with the first output gear 232*a*.

Figure 5:
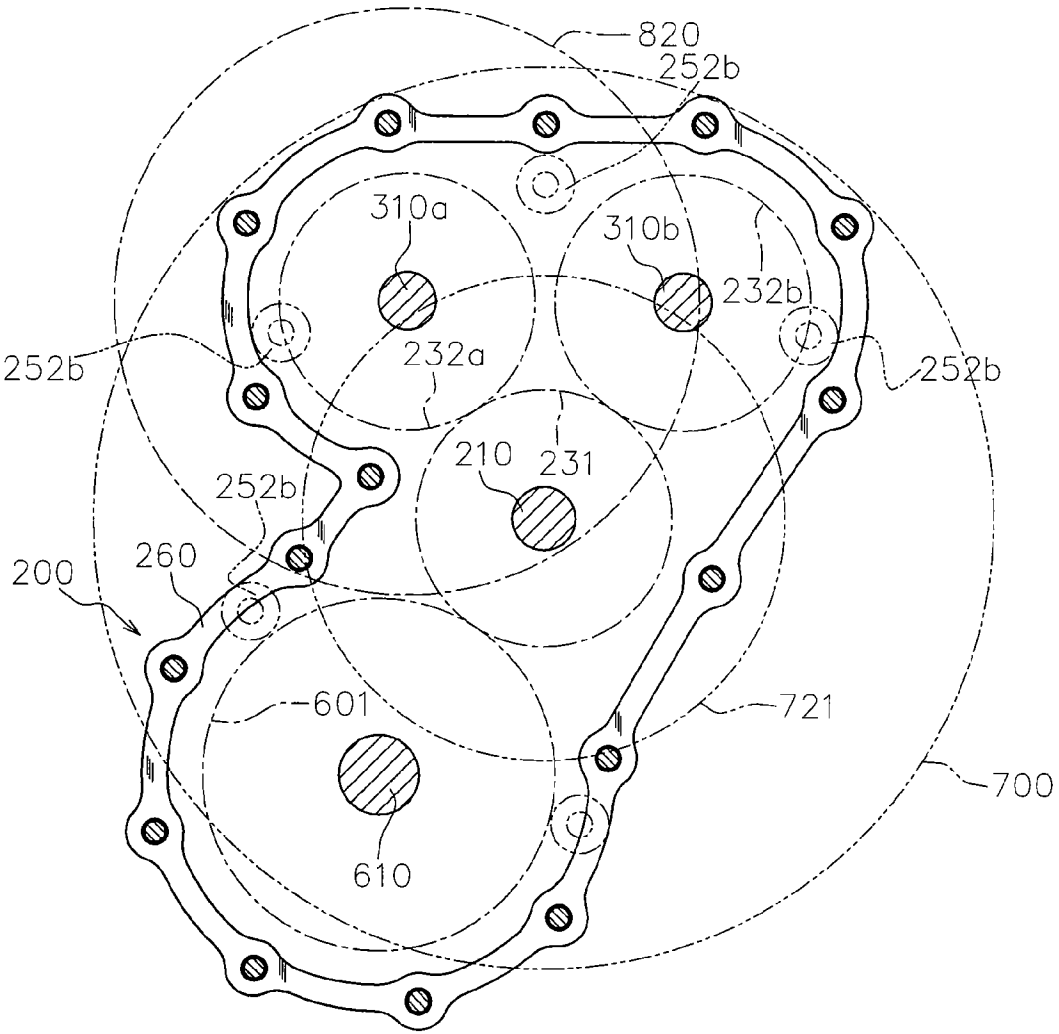
FIG. 5 is an end face view of a pump system modified from the first embodiment of the present invention.

In place of this configuration, as shown in FIG. 5, it is also possible to connect the first and second output gears 232*a*, 232*b* to the input gear 231 in parallel.

In other words, it is also possible to mesh the both of the first and second output gears 232*a*, 232*b* with the input gear 231.

The input gear 231 is also operatively connected to the PTO unit 600.

The PTO unit 600 has a PTO output gear 601 operatively connected with the input gear 231.

In this embodiment, the PTO unit 600 includes the PTO clutch mechanism 600A, which selectively engages or disengages power transmission from the PTO output gear 601 to the PTO shaft 610.

More specifically, as shown in FIG. 2, the PTO unit 600 includes the PTO shaft 610, a driving-side member 620 which is supported by the PTO shaft 610 in a relatively rotatable manner and has the PTO output gear 601, a driven-side member 630 supported by the PTO shaft 610 in a relatively non-rotatable manner, a driving-side friction plate 640 supported by the driving-side member 620 in a relatively non-rotatable manner, and a driven-side friction plate 650 supported by the driven-side member 630 in a relatively non-rotatable manner. The PTO unit 600 can selectively friction-engage the driving-side friction plate 640 and the driven-side friction plate 650 by means of the action of the hydraulic pressure.

The driving-side member 620, the driving-side friction plate 640, the driven-side member 630 and the driven-side friction plate 650 form the PTO clutch mechanism 600A.

In this embodiment, the PTO clutch mechanism 600A is configured so that the power is transmitted when the hydraulic pressure is supplied thereto, and the PTO clutch mechanism 600A is further includes a biasing member 660 to prevent the both friction plates 640 and 650 from being friction-engaged unintentionally when the hydraulic pressure is not supplied.

In this embodiment, the hydraulic pressure acting on the driving-side friction plate 640 and the driven-side friction plate 650 is supplied via an oil passage 256 formed in the thick portion 255, the rotary joint 611, and an axial hole 612 formed in the PTO shaft 640 (refer to FIG. 2).

More preferably, the PTO unit 600 can be provided with a PTO brake mechanism 600B. The brake mechanism 600B is configured to add a braking power to the PTO shaft 610 with being contradictory to the PTO clutch mechanism 600A.

In other words, when the driving-side friction plate 640 and the driven-side friction plate 650 are not engaged, the PTO brake mechanism 600B operatively adds the braking power to the PTO shaft 610, and when the driving-side friction plate 640 and the driven-side friction plate 650 are engaged, the PTO brake mechanism 600B releases the braking power.

In this embodiment shown in FIG. 4 and a modified configuration shown in FIG. 5, the first and second output shafts 220*a*, 220*b* and the PTO shaft 610 are distributed above and below with reference to the input shaft 210. However, it is obvious that the present invention is not limited to these configurations.

Figure 6:
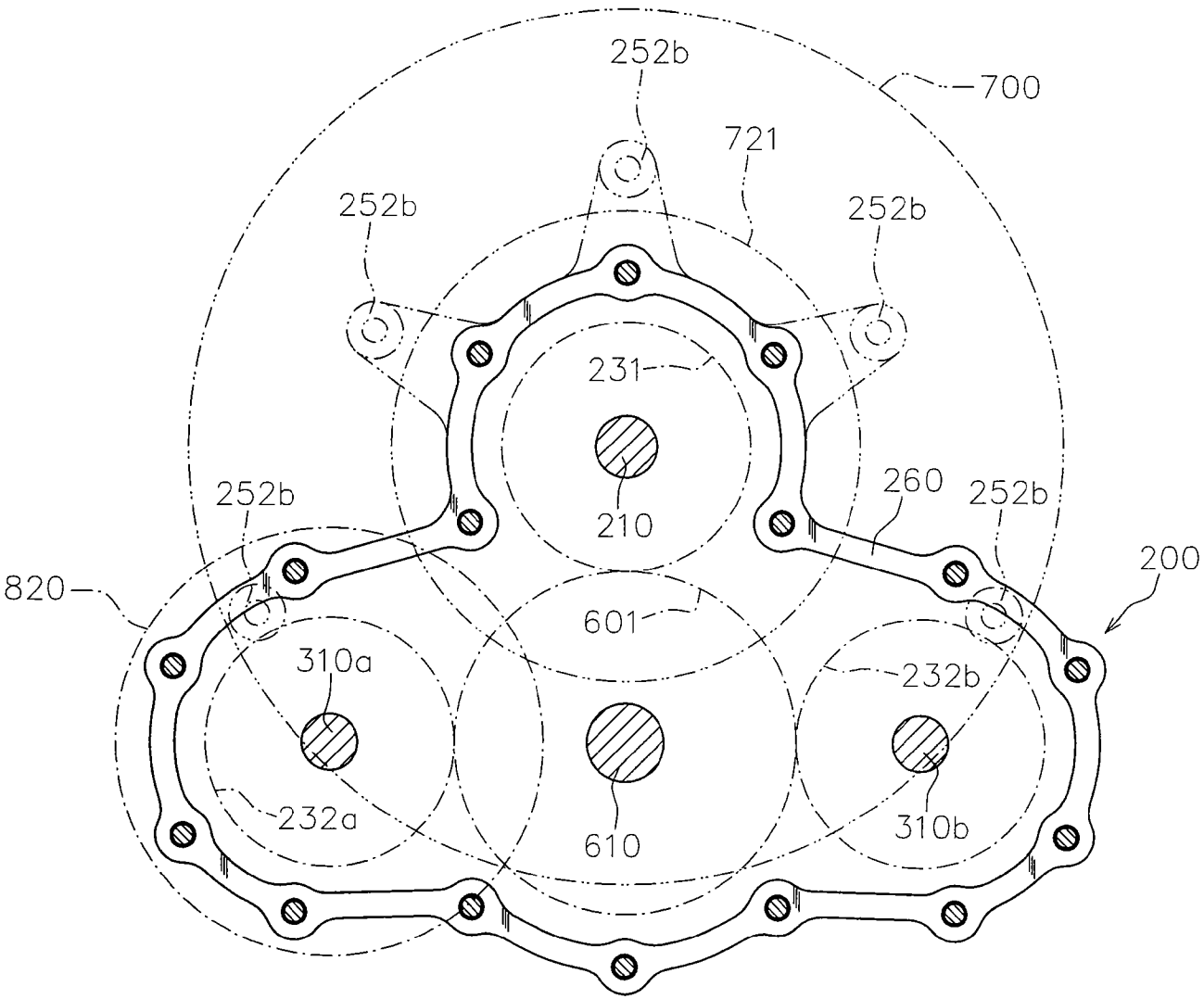
FIG. 6 is an end face view of another pump system modified from the first embodiment of the present invention.

For example, as shown in FIG. 6, in case of arranging the PTO shaft 610 below the input shaft 210, the first and second output shafts 220*a*, 220*b* can be distributed with reference to the PTO shaft 610.

In other words, in the configuration shown in FIG. 6, the input gear 231 is meshed with the PTO output gear 601, and the first and second output gears 232*a*, 232*b* are meshed with the PTO output gear 601, respectively.

Also according to this configuration shown in FIG. 6, it is possible to transmit the power from the input shaft 210 to the first and second output 232*a* and 232*b* and the PTO output gear 601.

The pump unit 300 has a plurality of pump shafts driven by the plurality of output portions of the base unit 200, respectively, a plurality of hydraulic pump bodies driven by the plurality of pump shafts, respectively, and a pump case accommodating the plurality of hydraulic pump bodies.

As described above, in this embodiment, the base unit 200 has the first and second output shafts 220*a*, 220*b*. Accordingly, as shown in FIG. 3 and FIG. 4, the pump unit 300 has first and second pump shafts 310*a*, 310*b*, and first and second hydraulic pump bodies 320*a* and 320*b*.

In this embodiment, the pump unit 300 has a single common pump case 330 accommodating the first and second hydraulic pump bodies 320*a* and 320*b*.

Herein, comparing this embodiment (refer to FIG. 4) with the configuration shown in FIG. 5, a distance between the first and second pump shafts 310*a*, 310*b* can be made shorter in FIG. 4 than in FIG. 5, and this leads to an advantage that the common pump case 330 can be made compact.

The second pump shaft 310*b* and the second hydraulic pump body 320*b* have substantially identical to the first pump shaft 310*a* and the first hydraulic pump body 320*a*, respectively.

Accordingly, in the figures, the second pump shaft 310*b* and the second hydraulic pump body 320*b* have been given the same reference characters as the first pump shaft 310*a* and the first hydraulic pump body 320*a* with changing final letter from "a" to "b", and a detailed description thereof is omitted.

In this embodiment, the first and second hydraulic pump bodies 320*a*, 320*b* are symmetrically arranged in the common pump case 330 with reference to a virtual plane that extends parallel to the first and second pump shafts 320*a*, 320*b* therebetween.

As shown in FIG. 2 and FIG. 3, the common pump case 330 has a peripheral wall 331 extending along the axial direction of the first and second pump shafts 310*a*, 310*b*, and an end wall 332 closing the second end side in the axial direction of the peripheral wall 331 (namely, the side adjacent to the base unit). At the first end side in the axial direction of the peripheral wall 331, an opening 339 through which the first and second hydraulic pump bodies 320*a* and 320*b* can be inserted is provided.

According to this embodiment, a single opening, namely, the opening 339 is provided in the common pump case 330. However, it is possible to provide a plurality of openings through which the first and second hydraulic pump bodies 320*a* and 320*b* can be inserted, respectively, by providing a partition wall in the common pump case 330 between the first and second hydraulic pump bodies 320*a* and 320*b*.

The common pump case 330 is configured so that the end wall 332 can be detachably connected to the outer surface of the second housing portion 260.

In this embodiment, the common pump case 330 is connected to the outer surface of the second housing portion 260 so as to be located above the PTO shaft 610.

Specifically, as shown in FIG. 2, the end wall 332 has a center portion 333 for supporting the first and second pump shafts 310*a*, 310*b* (FIG. 2 only shows the first pump shaft), and a flange portion 334 extended from the center portion 333 outward in a radial direction.

Then, the flange portion 334 is detachably connected to the outer surface of the second housing portion 260 via a fastening member such as a bolt.

Herein, of both wall faces of the base housing 240, the outer surface of the second housing portion 260 on which the common pump case 330 is placed is an outer surface of the second end wall 261 at the opposite side of the first end wall 251 through which the input shaft 21 protrudes. By employing such a configuration, it is possible to prevent interference between the common pump case 330 and the input shaft 210.

By the way, the expanded portion for housing the PTO clutch mechanism 600A is provided on the second end wall 261 of the second housing portion 260 configuring the outer surface, and the PTO shaft 610 protrudes the second wall 261. However, since the input shaft 210 is positioned between the first pump shaft 310*a* and the PTO shaft 610 to secure the distance between the first pump shaft 310*a* and the PTO shaft 610, it is possible to effectively prevent the common pump case 330 from interfering with this expanded portion and the PTO shaft 610.

The first and second pump shafts 310*a*, 310*b* are supported by the common pump case 330 so as to be connected to the corresponding first and second output shafts 220*a*, 220*b*, respectively, by connecting the end wall 332 of the common pump case 330 to the second housing portion 260.

As describe above, in this embodiment, the first and second output shafts 220*a*, 220*b* are accommodated in the base housing 240.

Accordingly, the first and second pump shafts 310*a*, 310*b* are extended outward from the common pump case 330 so as to be connected to the first and second output shafts 220*a*, 220*b* via the first and second access openings 261*a*, 261*b*, respectively, when the common pump case 330 is connected to the second housing portion 260 (refer to FIG. 2 and FIG. 3).

In this embodiment, as shown in FIG. 2 and FIG. 3, making the first and second output shafts 220*a*, 220*b* into hollow shafts, the first and second pump shafts 310*a*, 310*b* are splined to the center holes of the first and second output shafts 220*a*, 220*b*. However, it is possible to employ various connection structures as long as the corresponding pump shaft 310 and output shaft 220 are connected in a relatively non-rotatable manner.

For example, it is possible to support the first and second output shafts 220*a*, 220*b* by the base housing 240 so that their ends are extended outward, and the first and second pump shafts 310*a*, 310*b* are supported within the common pump case 330.

In addition, it is also possible to make the first and second pump shafts 310*a*, 310*b* into the hollow shafts, and the first and second output shafts 220*a*, 220*b* are internally inserted into the axial holes of the first and second pump shafts 310*a*, 310*b* in a relatively non-rotatable manner.

As shown in FIG. 2 and FIG. 3, the first hydraulic pump body 320*a* has a piston unit 321 to perform reciprocation in accordance with the rotation of the first pump shaft 310*a*, and a cylinder block 322 supporting this piston unit 321 in a reciprocatable manner.

As described above, in this embodiment, the first hydraulic pump body 320*a* is made into the variable displacement type.

Accordingly, in addition to the above configuration, the first hydraulic pump body 320*a* is provided with an output adjusting member 323 for adjusting the suction/discharge rates by changing a slidable range of the piston unit 321.

In this embodiment, a movable swash plate is used as the output adjusting member 323, and a shoe provided at the tip end of the piston unit 321 abuts against the output adjusting member 323.

The output adjusting member 323 can be operated from the outside by a control shaft 324.

In this embodiment, as the control shaft 324, a trunnion shaft that is linked with the output-adjusting member 323 via an arm is used.

Figure 7:
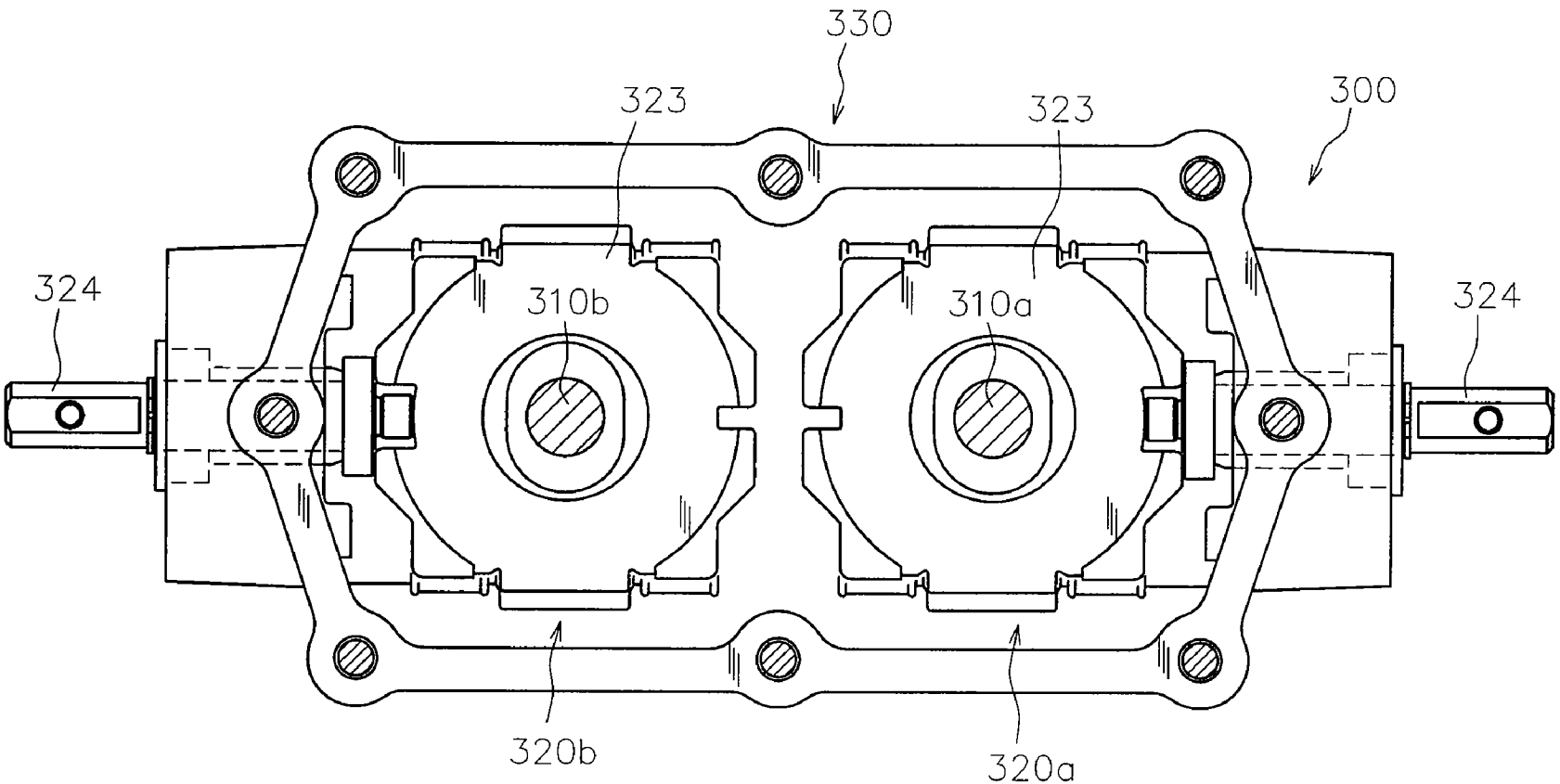
FIG. 7 is an end face view taken along line VII-VII in FIG. 3 with each cylinder block in the first and second hydraulic pump bodies removed.

FIG. 7 is an end face view taken along line VII-VII in FIG. 3 with each cylinder block 322 in the first and second hydraulic pump bodies 320*a*, 320*b* removed.

As shown in FIG. 3 and FIG. 7, in this embodiment, the first and second hydraulic pump bodies 320*a*, are configured so that respective control shafts 324 extend to the opposite directions each other.

In other words, the control shaft 324 for controlling the output of the first pump body 320*a* extends to a first side in a width direction of the vehicle and the control shaft 324 for controlling the output of the second pump body 320*b* extends to a second side opposite to the first side in the width direction of the vehicle.

Each of the control shafts 324 extending to the first and second sides in the width direction of the vehicle (the right-to-left direction of the vehicle), as shown in FIG. 10, is operatively connected to right and left manipulating levers 35 that are arranged in the vicinity of a driver seat of the working vehicle 1 via a link mechanism 80 including an operation arm 81 connected to the control shaft 324 and a link member 82 connected to the operation arm 81.

As described above, the pump system 100 according to this embodiment is supported by the driving source 40 with being free against the vehicle frame 30 so that the pump system is vibrated together with the driving source 40 relative to the vehicle frame 30.

Accordingly, when the control shafts 324 and the levers 35 are operatively connected via the link mechanism 80 made of a rigid member, the vibration is transmitted from an assembly formed by the driving source 40 and the hydraulic pump system 100 to the lever 35.

In order to prevent or reduce such transmission of the vibration to the lever 35, it is preferable that a vibration-absorbing member is inserted through the rigid link mechanism 80.

In this embodiment, as shown in FIG. 10, as the vibration-absorbing member, an elastic coupling member 85 (for example, rubber) is inserted between the operation arm 81 and the link member 82.

Alternatively, by operatively connecting the control shaft 324 and the lever 35 via a flexible operation power transmitting mechanism (not shown) such as a wire, it is also possible to prevent or reduce such transmission of the vibration to the lever 35.

Further, in this embodiment, as shown in FIG. 2 and FIG. 3, the pump unit 300 has a single common port block (or a single common center section) 340 that is connected to the common pump case 320 so as to close the opening 339 of the common pump case 330.

Figure 8:
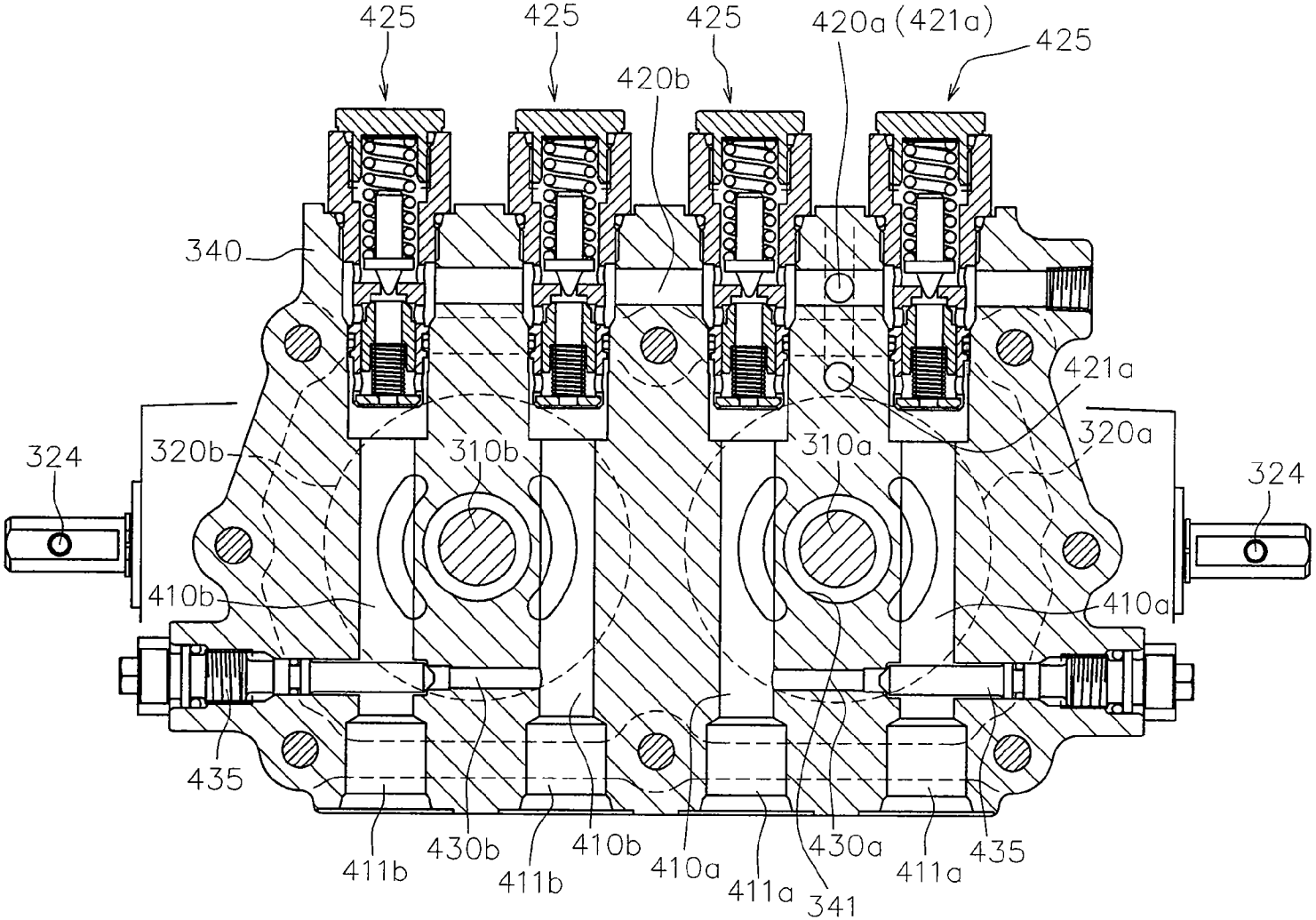
FIG. 8 is a transverse sectional view taken along line VIII-VIII in FIG. 3.

FIG. 8 is a transverse sectional view of the common port block 340 taken along line VIII-VIII in FIG. 3.

As shown in FIG. 1 and FIG. 8, the common port block 340 is provided with a pair of first operation oil passages 410*a* configuring a part of a pair of first operation oil lines 400*a* to fluidly connect between the first hydraulic pump body 320*a* and the hydraulic motor body of the first hydraulic motor unit 10, a first bypass oil passage 430*a* communicating between the pair of first operation oil passages 410*a*, a pair of second operation oil passages 410*b* configuring a part of a pair of second operation oil lines 400*b* to fluidly connect between the second hydraulic pump body 320*b* and the hydraulic motor body of the second hydraulic motor unit 10, and a second bypass oil passage 430*b* communicating between the pair of second operation oil passages 410*b*.

In this embodiment, as shown in FIG. 8, the pair of first operation oil passages 410*a* and the pair of second operation oil passages 410*b* are formed approximately in parallel each other so as to extend orthogonal to the axial direction of the control shaft 324, respectively.

Further, the port block 340 is provided with a first charge oil passage 420*a*, of which a first end is opened to the outer surface to form a charge port 420P, and a second charge oil passage 420*b* that is extended in parallel with the axial line of the control shaft so as to intersect with the pair of first operation oil passages 410*a* and the pair of second operation oil passages 410*b*.

Herein, a check valve 425 (to be described later) is inserted at the each intersection between the pair of first operation oil passages 410*a* and the second charge oil passage 420*b*, and between the pair of second operation oil passages 410*b* and the second charge oil passage 420*b*, respectively.

In each of the pair of first operation oil passages 410*a*, a first end is opened to the outer surface (the lower surface according to this embodiment) at a first side of the common port block 340 to form a pair of first operation oil port 411*a*, a second end is opened to the outer surface (the upper face in this embodiment) at a second side of the common port block 340, and a halfway portion between the first end and the second end is fluidly connected to the first hydraulic pump body 320*a* via a kidney port.

Herein, each second end of the pair of first operation oil passages 410*a* is sealed via the check valve 425 (to be described later).

Similarly, in each of the pair of second operation oil passages 410*b*, a first end is opened to the outer surface (the lower face in this embodiment) at the first side of the common port block 340 to form a pair of second operation oil port 411*b*, a second end is opened to the outer surface (the upper face in this embodiment) at the second side of the common port block 340, and a halfway portion between the first end and the second end is fluidly connected to the second hydraulic pump body 320*b* via a kidney port.

Then, each second end of the pair of second operation oil passages 410*b* is sealed via the check valve 425 (to be described later).

In this embodiment, as shown in FIG. 2 and FIG. 3, in addition to the above configuration, the pump unit 300 further includes a charge pump body 500 driven by the first pump shaft 310*a*, and a charge pump case 510 connected to the port block 340 so as to surround the charge pump body 500.

More specifically, in the first pump shaft 310*a*, the second end of the opposite side of the first end connected to the first output shaft 220*a* is extended outward through the common port block 340.

Then, the second end of the first pump shaft 310*a* drives the charge pump body 500.

Figure 9:
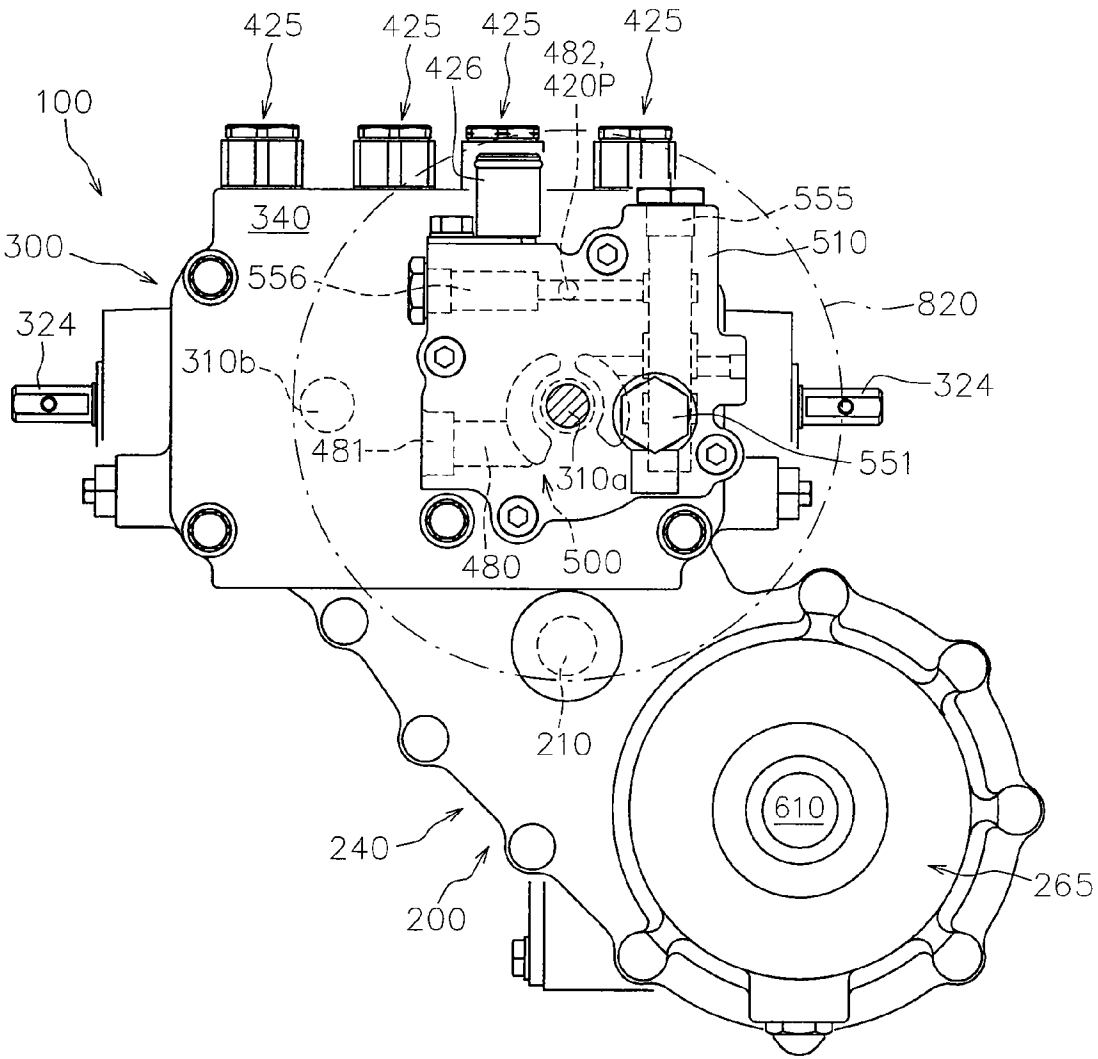
FIG. 9 is an end face view taken along line IX-IX in FIG. 3.

FIG. 9 is an end face view taken along line IX-IX in FIG. 3.

As shown in FIG. 9, an oil supply passage 480 is formed in the charge pump case 510. The oil supply passage has a first end opened to the outer surface so as to form a suction port 481, and a second end opened to the abutting face with the port block 340 so as to form a discharge port 482.

Then, the charge pump body 500 is arranged so as to be inserted in the oil supply passage 480.

In this embodiment, the suction port 481 is fluidly connected to an outer reserve tank 90 via appropriate external conduit 485 and filter 486 (refer to FIG. 1).

Further, as shown in FIG. 1 and FIG. 9, the discharge side of the oil supply passage 480 is branched into a PTO operation oil passage 550 and a main charge oil passage 482 by a flow control valve 555.

More specifically, the PTO operation oil passage 550 is formed in the charge pump case 510 in such a manner that a first end communicates with the discharge side of the oil supply passage 480 via the flow control valve 555, and a second end is opened to the outer surface to form a PTO extraction port 551.

In this embodiment, the PTO extraction port 551 is fluidly connected to the oil passage 256 formed on the thick portion 255 via an appropriate external conduit (refer to FIG. 1 and FIG. 2).

As shown in FIG. 1 and FIG. 2, a switching valve 291, a relief valve 292 and an accumulator 293 are mounted in the thick portion 255 so as to be inserted in the oil passage 256.

In place of the external conduit, it is possible to fluidly connect the PTO extraction port 551 to the oil passage 256 via the inner conduit provided in the common pump case and the base housing, or the oil passage formed therein.

The main charge oil passage 482 is formed in the charge pump case 510 in such a manner that a first end communicates with the discharge side of the oil supply passage 480 via the flow control valve 555, and a second end is opened to the abutting face with the common port block 340 to form the discharge port.

As shown in FIG. 1 and FIG. 9, in the charge pump case 510, a charge relief valve 556 is mounted to set a hydraulic pressure of the main charge oil passage 482.

In this embodiment, a drain port 426 of the charge relief valve 556 is provided in the charge pump case 510, and an oil from the drain port 426 is returned within the base housing 240 via an external conduit 428 in which an oil cooler 427 is inserted (refer to FIG. 1).

In the common pump case 330 and the base housing 240, an oil passage 429 (refer to FIG. 1 and FIG. 3) is formed. When a leak oil from the first and second hydraulic pump bodies 320*a*, 320*b* in the common pump case 330 exceeds a predetermined quantity, the leak oil flows into the base housing 240 via the oil passage 429.

Then, in this way, the oil collected in the base housing 240 returns to the outer reserve tank 90 through an external oil conduit 495.

With such a structure, it is possible to effectively prevent a temperature of the reserved oil in the base housing 240 and the common pump case 300 from being increased.

The first charge oil passage 420*a* is configured so as to introduce the pressure oil supplied from the main charge oil passage 482 to the second charge oil passage 420*b*.

Specifically, as shown in FIG. 1, FIG. 8 and FIG. 9, the first charge oil passage 420*a* has a first end that is opened to the abutting face with the charge pump case 510 so as to form the charge port 420P communicating to the discharge port of the main charge oil passage 482, and a second end that is communicated with the second charge oil passage 420*b*.

As shown in FIG. 1 and FIG. 8, the check valve 425 is inserted in the second charge oil passage 420*b* so as to allow the pressure oil to flow into the pair of first operation oil passages 410*a* and the pair of second operation oil passages 410*b* from the first charge oil passage 420*a*, respectively, and to prevent the reverse flow thereof.

In this embodiment, the check valve 425 has a relief valve function that is activated when the pressures within the corresponding operation oil passages 410*a*, 401*b* are made extraordinarily high.

In this embodiment, as shown in FIG. 8, the pair of first operation oil passages 410*a* and the pair of second operation oil passages 410*b* are formed so as to be approximately in parallel with each other.

In addition, the second charge oil passage 420*b* extends in a direction orthogonal to the pair of first operation oil passages 410*a* and the pair of second operation oil passages 410*b* so as to communicate therewith.

Then, the check valve 425 with the relief valve function is inserted in a portion where the second charge oil passage 420*b* is communicated with the respective operation oil passages 410*a*, 410*b*.

With such a configuration, it is possible to easily form a charge oil passage while making the common port block 340 compact.

As shown in FIG. 8, the first and second bypass oil passages 430*a*, 430*b* are formed to communicate between the pair of first operation oil passages 410*a* and between the pair of second operation oil passages 410*b*, respectively. In this embodiment, the first and second bypass oil passages 430*a*, 430*b* are opened to the right and left outer side faces of the port block 340.

Each of the first and second bypass oil passages 430*a*, 430*b* is selectively communicated or blocked by a switching valve 435. The switching valve 435 is screwed to seal the opening end of the corresponding bypass oil passage with being operable from the outside.

In this embodiment, the switching valve 435 is directed in the same direction as the corresponding control shaft 324.

Further, in this embodiment, as shown in FIG. 4, the first and second output gears 232*a*, 232*b* are directly meshed with each other. According to this configuration and the modified configuration that the first and second output gears 232*a*, 232*b* are arranged adjacently as shown in FIG. 5, it is possible to accommodate the first and second hydraulic pump bodies 320*a*, 320*b* in the common pump case 330 and the opening 339 of the common pump case 330 can be closed by the common port block 340.

On the contrary, in the modified configuration that the first and second output gears 232*a*, 232*b* are distributed across the PTO output gear 601 as shown in FIG. 6, the first and second hydraulic pump bodies 320*a*, 320*b* are accommodated in dedicated pump cases (not shown), respectively. In the configuration, the openings of the dedicated pump cases can be closed by dedicated port blocks (not shown), respectively.

As shown in FIG. 2 and FIG. 3, in this embodiment, the pump unit 300 further includes a cooling fan unit 800 operatively driven by the first pump shaft 301*a* in addition to the above-mentioned configuration.

The cooling fan unit 800 has a fan shaft 810 operatively connected to the first pump shaft 301*a*, and a fan body 820 supported by the fan shaft 810 in a relatively non-rotatable manner.

In this embodiment, the fan shaft 810 is connected to the first pump shaft 310*a* within the charge pump case 510 in a relatively non-rotatable manner around the axial line thereof.

More specifically, as shown in FIG. 3 and FIG. 8, a first through hole 341 for supporting the first pump shaft 310*a* is formed in the common port block 340.

In addition, in the charge pump case 510, a second through hole 511 arranged concentrically with the first through hole 341 is formed.

With such a configuration, the second end of the first pump shaft 310*a* penetrates through the second through hole 511, and the fan shaft 810 is connected with the second end of the first pump shaft 310*a* within the second through hole 511 in a relatively non-rotatable manner around the axial line thereof.

In place of such a configuration, extending the tip end of the first pump shaft 310*a* to the outside from the second through hole 511 of the charge pump case 510, the fan body 820 can be also set on the tip end. According to this replacement configuration, it is possible to eliminate the need for the fan shaft 810.

According to the pump system 100 of this embodiment of such a configuration, it is possible to obtain the following advantages in addition to the above-mentioned various advantages.

In other words, in the pump system 100, the PTO unit 600 is accommodated within the base unit 200 supported by the supporting member such as the driving source. Then, the pump unit 300 including the common pump case 330, the first and second pump shafts 310*a*, 310*b* and the first and second hydraulic pump bodies 320*a*, 320*b* is detachably connected to the base unit 200.

Accordingly, without detaching the transmission mechanism to transmit the power from the driving source 40 to the base unit 200 and the transmission mechanism to transmit the power from the PTO unit 600 to the working machine such as a mower machine, only the pump unit 300 can be detached. Therefore, it is possible to efficiently carry out the replacement work of the hydraulic pump bodies 320*a*, 320*b* and the maintenance work thereof.

In addition, as described above, the pump system 100 according to this embodiment is provided with the single common port block 340 for the first and second hydraulic pump bodies 320*a*, 320*b*.

Accordingly, the pressure oil from the charge pump body 500 driven by one pump shaft (the first pump shaft 310*a* in this embodiment) can be efficiently supplied to the both of the first and second hydraulic pump bodies 320*a*, 320*b* via the oil passage formed in the common port block 340.

Herein, this embodiment is configured so that the charge pump body 500 and the cooling fan unit 800 are driven by the first pump shaft 310*a*, however, in place of this configuration, the present invention can be also configured so that the charge pump body 500 and the cooling fan unit 800 are driven by the second pump shaft 310*b*.

In addition, it is also possible to configure the present invention so that one of the charge pump body 500 and the cooling fan unit 800 is driven by the first pump shaft 310*a* and the other one of the charge pump body 500 and the cooling fan unit 800 is driven by the second pump shaft 310*b*.

Further, it is also possible to configure the present invention so that the charge pump body 500 and/or the cooling fan unit 800 are/is driven by one of the first and second pump shafts 310*a*, 310*b*, and another auxiliary pump body and/or the cooling fan unit 800 are/is driven by the other one of the first and second pump shafts 310*a*, 310*b*.

Embodiment 2

Another embodiment of the pump system according to the present invention will be described below with reference to the attached drawings.

Figure 11:
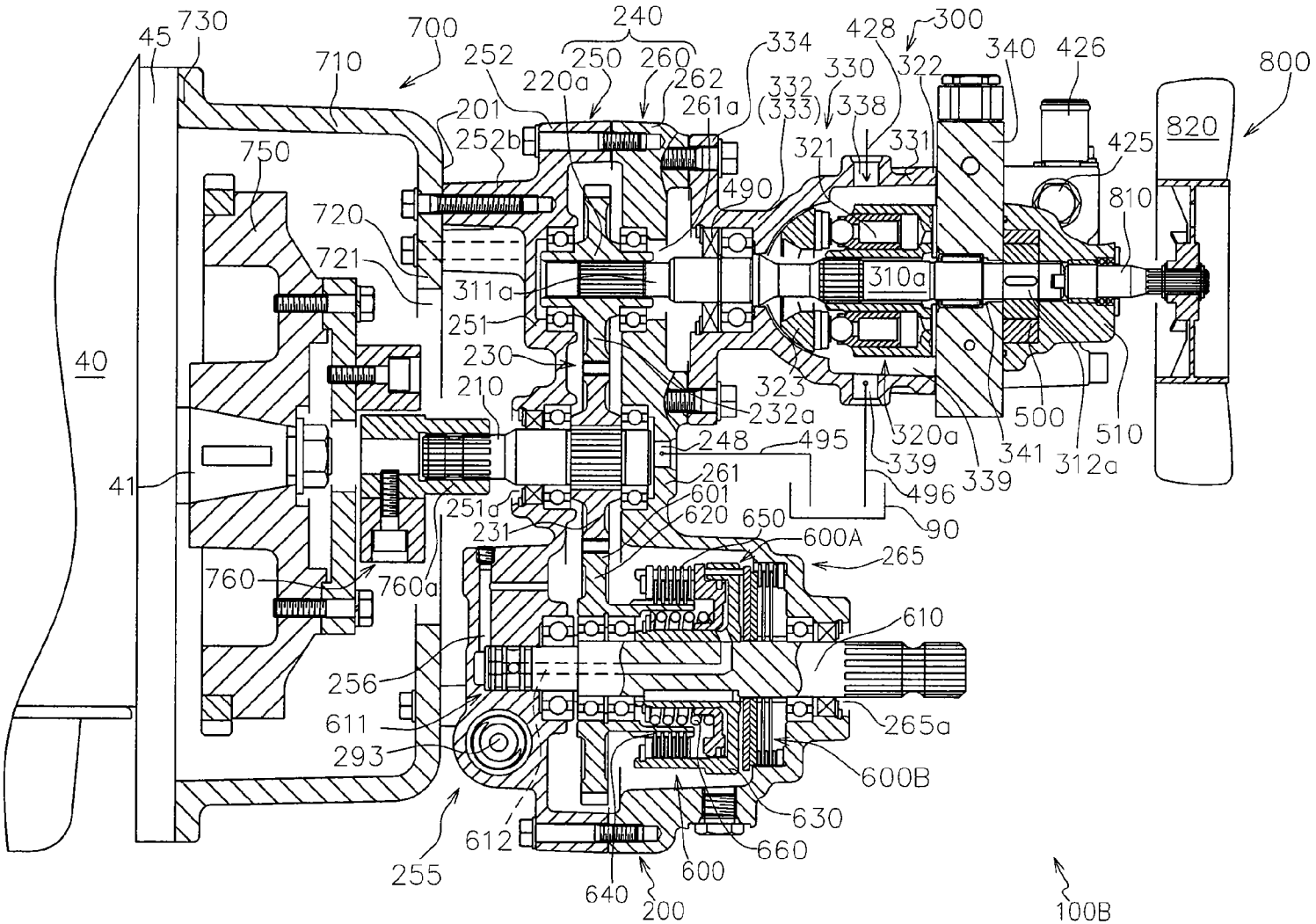
FIG. 11 is a longitudinal sectional side view of a pump system according to a second embodiment of the present invention.

FIG. 11 is a longitudinal sectional side view of a pump system 100B according to this embodiment.

Herein, in the figure, the identical members in the first embodiment are given the identical reference numerals to omit their explanations.

According to the pump system 100 according to the first embodiment, between the common pump case 330 and the base housing 240, the oil can be freely circulated via the oil passage 429, the overflow oil from the common pump case 330 flows into the base housing 240 via the oil passage 429, and the cooling oil from the oil cooler 427 flows into the base housing 240, and the oil collected within the base housing 240 is returned to the oil tank 90. On the contrary, according to the pump system 100B of this embodiment, the inner space of the common pump case 330 and the inner space of the base housing 240 are zoned in liquid tight.

Specifically, in the pump system 100B, the oil passage 429 is removed. In addition to this, at least one of the openings, for allowing the corresponding pump shafts 310*a*, 310*b* and the corresponding output shafts 220*a*, 220*b* to be connected, provided in the common pump case 330 and the base housing 240 (the opening provided in the common pump case 330 in this embodiment) is sealed by a sealing member 490.

Further, as shown in FIG. 11, the common pump case 330 is provided with a pair of oil ports 338, 339 for opening the inner spaces of the common pump case 330 to the outside.

The oil port 338 is fluidly connected to the external conduit 428 so as to receive the cooled oil from the oil cooler 427. The oil port 339 is fluidly connected to the oil tank 90 via the external conduit 496 to return the overflow oil from the common pump case 330 to the oil tank 90.

According to the pump system 100B of such a configuration, since the cooled oil directly flows into the common pump case 330 from the oil cooler 427, it is possible to efficiently cool the first and second hydraulic pump bodies 320*a*, 320*b*.

Further, since the cooled oil from the oil cooler 427 does not flow into the base housing 240, it is possible to reduce a stirring resistance of the transmission portion 230.

It is preferable that an oil port 248 can be provided in the base housing 240, which opens the inner space of the base housing 240 to the outside.

In other words, as described above, the PTO clutch mechanism 600A is accommodated within the base housing 240. Therefore, the drain oil from the PTO clutch mechanism is reserved within the base housing 240.

Accordingly, by flowing the drain oil in the base housing 240 to the outside via the oil port 248, it is possible to effectively reduce the stirring resistance of the transmission portion 230.

Specifically, the oil port 248 is fluidly connected to the oil tank 90 via the external oil conduit 495.

Preferably, under the state that the pump system 100B is mounted on the supporting member, the oil port 248 is positioned so as to be below an uppermost bearing portion (i.e. the bearing portions for the first and second pump shafts 310*a*, 310*b* and the first and second output shafts 220*a*, 220*b* in the configurations shown in FIG. 4 and FIG. 5, and the bearing portion for the input shaft 210 in the configuration shown in FIG. 6) of the bearing portions formed in the base housing 240, and allow the uppermost bearing portion to be automatically lubricated by the rotation of the gear configuring the transmission portion 230 (or to be lubricated with an oil scattered by the rotation of the gear).

In this embodiment, under the state that the pump system 100B is mounted to the driving source 40, the oil port 248 is positioned in the vicinity of the lower end position of the gear corresponding to the uppermost bearing portion in a vertical direction (i.e. at lease one of the first and second output gears 232*a*, 232*b* in the configuration shown in FIG. 4 and FIG. 5, and the input gear 231 in the configuration shown in FIG. 6).

With such a configuration, it is possible to overflow the oil to the oil tank 90 via the oil port 248, while lubricating the transmission portion 230 by the reserved oil in the base housing 240.

Accordingly, while maintaining a lubricant efficiency to the transmission portion 230, it is possible to reduce the stirring resistance of the transmission portion 230 as effective as possible.

Embodiment 3

A pump unit 300C according to still another embodiment of the present invention will now be described with reference to the attached drawings.

Figure 12:
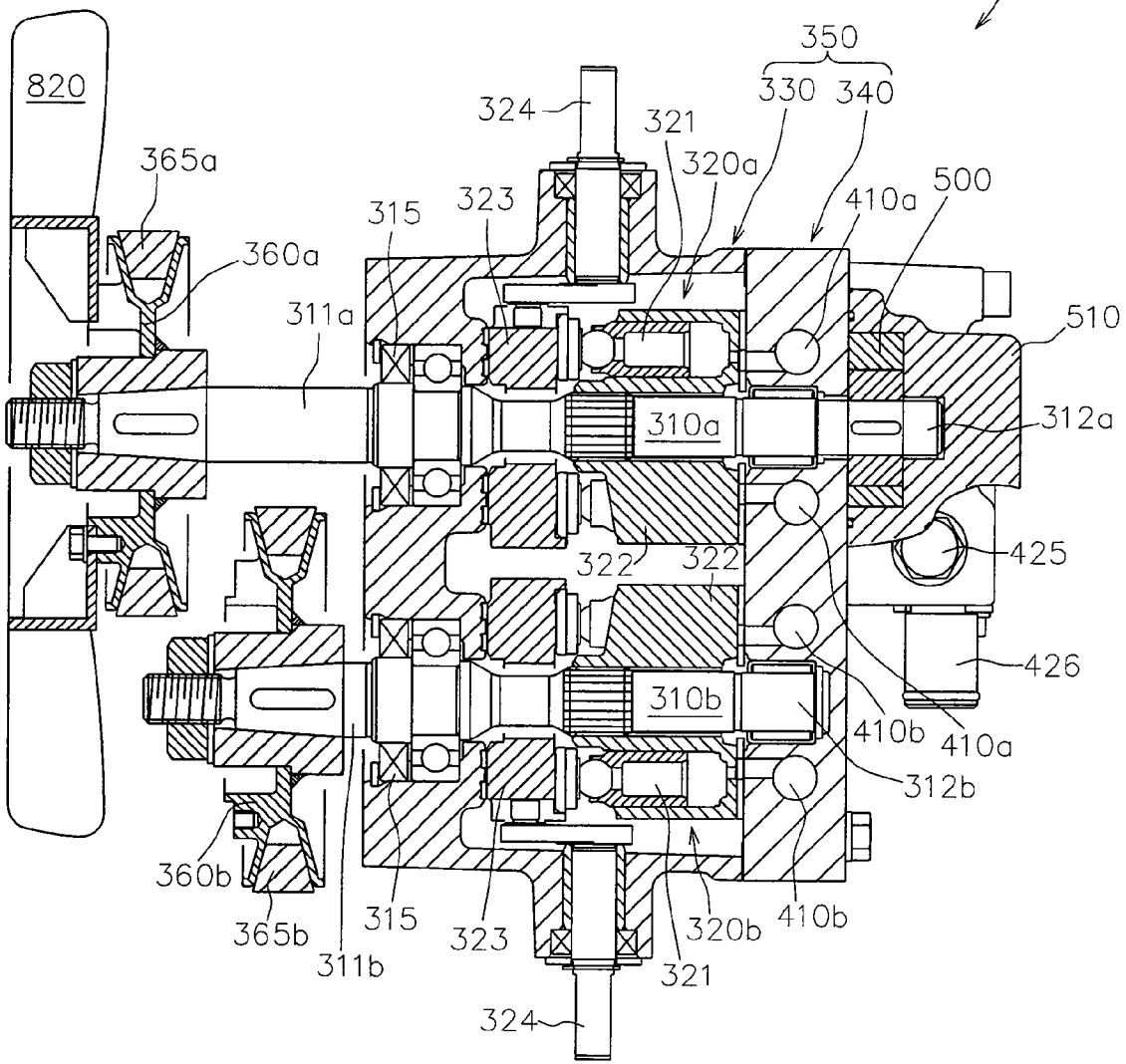
FIG. 12 is a cross sectional view of a pump unit according to a third embodiment of the present invention.

FIG. 12 is a cross sectional view of the pump unit 300C according to the present embodiment.

In the drawing, the same elements as those of the first or second embodiment have been given the same reference characters to appropriately omit a detailed description thereof.

The pump unit 300C is identical to the pump unit 300 according to the first and second embodiments in that there are provided the plurality of hydraulic pump bodies 320*a*, 320*b* disposed in parallel to each other, the plurality of pump shafts 310*a*, 310*b* which respectively support the plurality of hydraulic pump bodies 320*a*, 320*b* in a relatively non-rotatable manner, and the pump housing 350 which accommodates therein the plurality of hydraulic pump bodies 320*a*, 320*b* and supports the plurality of pump shafts 310*a*, 310*b* in a rotatable manner around its respective axis lines, and in that each of the plurality of pump shafts 310*a*, 310*b* has at least one end extended outward from the pump housing 350 so as to form an input end.

Specifically, the pump unit 300C includes the first and second hydraulic pump bodies 320*a*, 320*b* disposed in parallel to each other, the first and second pump shafts 310*a*, 310*b* which respectively support the first and second hydraulic pump bodies 320*a*, 320*b* in a relatively non-rotatable manner, and the pump housing 350 which accommodates therein the first and second hydraulic pump bodies 320*a*, 320*b* and supports the first and second pump shafts 310*a*, 310*b* in a rotatable manner around the respective axis lines, the pump housing 350 including the pump case 330 and the center section 340, likewise to the pump unit 300 according to the first and second embodiments.

The first pump shaft 310*a* has at least one end extended outward from the pump housing 350 so as to form the input end operatively connected to the driving power source 40, in the same manner as in each of the embodiments.

The second pump shaft 310*b* also has at least one end extended outward from the pump housing 350 so as to form the input end operatively connected to the driving power source 40, in the same manner as in each of the embodiments.

Specifically, as shown in FIGS. 2, 3, 11 and 12, the first pump shaft 310*a* has first and second ends 311*a*, 312*a* respectively located on one side and the other side in the axis line direction with a portion supporting the first hydraulic pump body 320*a* being sandwiched therebetween.

The second pump shaft 310*b* has first and second ends 311*b*, 312*b* respectively located on the same sides as the first and second ends 311*a*, 312*a* of the first pump shaft 310*a* in the axis line direction.

The first ends 311*a*, 311*b* of the first and second pump shafts 310*a*, 310*b* are extended outward from the pump housing 350 to form the respective input ends (see FIGS. 2, 3, 11 and 12).

The pump unit 300C according to the present embodiment is different from the pump unit 300 according to the first and second embodiments in that power transmission from the driving power source 40 to the first and second pump shafts 310*a*, 310*b* is performed through first and second input pulleys 360*a*, 360*b* respectively supported at the input ends of the first and second pump shafts 310*a*, 310*b* in a relatively non-rotatable manner.

That is, the pump unit 300 according to the first and second embodiments is configured such that power transmission from the driving power source 40 to the first and second pump shafts 310*a*, 310*b* is performed through the base unit 200.

Specifically, in the first and second embodiments, power transmission from the driving power source 40 to the first and second pump shafts 310*a*, 310*b* is performed through the transmission portion 230 (including the input gear 231, the first output gear 232*a* and the second output gear 232*b*) accommodated inside of the base housing 240 that stores oil therein, as shown in FIGS. 2, 3 and 11.

With the above-described configuration, the oil stored inside of the base housing 240 causes resistance against the rotation of the transmission portion 230, resulting in the problem of degrading transmission efficiency from the driving power source 40 to the first and second pump shafts 310*a*, 310*b*.

Furthermore, the configuration in the first and second embodiments requires the transmission portion 230 (including the input gear 231, the first output gear 232*a* and the second output gear 232*b*) and the gear case (i.e., the base housing 240 in the first and second embodiments) accommodating therein the transmission portion 230 to be included in the pump unit, resulting in another problem of inviting cost increase of a power transmission mechanism from the driving power source 40 to the first and second pump shafts 310*a*, 310*b*.

In contrast, the pump unit 300C according to the present embodiment includes the first and second input pulleys 360*a*, 360*b* respectively supported at the input ends of the first and second pump shafts 310*a*, 310*b* in a relatively non-rotatable manner, as shown in FIG. 12.

The pump unit 300C is configured so that power transmission from the driving power source 40 to the first pump shaft 310*a* is performed through the first input pulley 360*a* and a first endless belt 365*a* wound around the first input pulley 360*a*, and power transmission from the driving power source 40 to the second pump shaft 310*b* is performed through the second input pulley 360*b* and a second endless belt 365*b* wound around the second input pulley 360*b*.

The pump unit 300C with such a configuration could omit the input gear 231, the first output gear 232*a*, the second output gear 232*b* and the gear case for accommodating these gears therein, thereby achieving cost reduction of the power transmission mechanism from the driving power source 40 to the first and second pump shafts 310*a*, 310*b* as much as possible.

Furthermore, according to the pump unit 300C, the power transmission mechanism extending from the driving power source 40 to the first and second pump shafts 310*a*, 310*b* suffers no agitation resistance due to the stored oil, thereby enhancing transmission efficiency of the power transmitting mechanism.

A reference numeral 315 in FIG. 12 denotes a seal member 315 for preventing the oil stored inside of the pump housing 350 from leaking to the outside.

Furthermore, in the present embodiment, as shown in FIG. 12, the first end 311*a* of the first pump shaft 310*a* positioned on the one side in the axis line direction forms the input end of the first pump shaft 310*a*, the first end 311*b* of the second pump shaft 310*b* located on the same sides in the axis line direction as the first end 311*a* of the first pump shaft 310*a* forms the input end of the second pump shaft 310*b*, and the first and second input pulleys 360*a*, 360*b* respectively supported at the first ends 311*a*, 311*b* of the first and second pump shafts 310*a*, 310*b* in a relatively non-rotatable manner are displaced from each other with respect to the axis line direction.

With the above-described configuration, it is possible to enhance design freedom of the first and second input pulleys 360*a*, 360*b* without enlarging a distance between the axis lines of the first and second pump shafts 310*a*, 310*b* while simplifying the structure of the power transmission mechanism from the driving power source 40 to the first and second input pulleys 360*a*, 360*b*.

In the present embodiment, the first input pulley 360*a* is positioned away from the pump housing 350 than the second input pulley 360*b*, as shown in FIG. 12.

The pump unit 300C may include the cooling fan body 820, as in the first and second embodiments.

Preferably, the cooling fan body 820 may be supported in a relatively non-rotatable manner by one pump shaft (the first pump shaft 310*a* in the present embodiment) of the first and second pump shafts 360*a*, 360*b* supporting one input pulley (the first input pulley 360*a* in the present embodiment) of the first and second input pulleys 360*a*, 360*b* positioned away from the pump housing 350 than the other input pulley, the cooling fan 820 being positioned on one side of the one input pulley in the axis line direction, as shown in FIG. 12.

With the above-described configuration, the cooling fan body 820 can be provided without degrading design freedom.

Additionally, the pump unit 300C may include the charge pump body 500 that is driven by one of the first and second pump shafts 310*a*, 310*b*, as in the first and second embodiments.

For example, the pump unit 300C may be configured such that one of the second ends 312*a*, 312*b* of the first and second pump shafts 310*a*, 310*b* is extended outward from the pump housing 350 to form an output end which drives the charge pump body 500.

In the present embodiment, as shown in FIG. 12, the second end 312*a* of the first pump shaft 310*a* supporting the cooling fan body 820 is extended outward from the pump housing 350, so that the second end 312*a* of the first pump shaft 310*a* drives the charge pump body 500.

What is claimed is:

1. A pump unit comprising:

first and second hydraulic pump bodies disposed in parallel to each other;

first and second pump shafts respectively supporting the first and second hydraulic pump bodies in a relatively non-rotatable manner and disposed in parallel to each other; and a pump housing accommodating the first and second pump bodies and supporting the plurality of pump shafts in a rotatable manner around respective axis lines, wherein the first pump shaft has first and second ends respectively positioned on one side and the other side in the axis line direction, the second pump shaft has first and second ends respectively positioned on the same sides as the first and second ends of the first pump shaft in the axis line direction, the pump housing includes a common pump case with an opening through which the first and second hydraulic pump bodies can be inserted, and a port block detachably connected to the common pump case so as to close the opening, the common pump case has a peripheral wall extending along the axis line direction of the first and second pump shafts and an end wall closing one side of the peripheral wall in the axis line direction so as to face the port block with the first and second hydraulic pump bodies sandwiched therebetween, the first ends of the first and second pump shafts extend outward from the same wall of the pump housing so as to form respective input ends, the pump unit further comprises first and second input pulleys respectively supported by the input ends of the first and second pump shafts in a relatively non-rotatable manner, and the first and second pulleys are displaced from each other with respect to the axis line direction of the first and second pump shafts.

2. The pump unit according to claim 1, further comprising a cooling fan, wherein the cooling fan is supported in a relatively non-rotatable manner by one pump shaft that supports one input pulley of the first and second input pulleys positioned farther away from the pump housing than the other input pulley, the cooling fan being positioned on one side of the one input pulley in the axis line direction.

3. A pump unit according to claim 1, wherein the first and second input pulleys are partially overlapped with each other as viewed along the axis line direction of the first and second pump shafts.

* * * * *